US011819775B1

(12) United States Patent
Liu

(10) Patent No.: US 11,819,775 B1
(45) Date of Patent: Nov. 21, 2023

(54) SINGLE-SHOT/REPEATING SWITCHING DEVICE OF TOY GUN

(71) Applicant: ACTION-ARMY COMPANY, New Taipei (TW)

(72) Inventor: Yung-Nung Liu, New Taipei (TW)

(73) Assignee: ACTION-ARMY COMPANY, New Taipei (TW)

( * ) Notice: Subject to any disclaimer, the term of this patent is extended or adjusted under 35 U.S.C. 154(b) by 10 days.

(21) Appl. No.: 17/851,052

(22) Filed: Jun. 28, 2022

(51) Int. Cl.

| | |
|---|---|
| ***A63H 5/04*** | (2006.01) |
| ***F41A 19/46*** | (2006.01) |
| ***F41B 11/646*** | (2013.01) |
| ***F41B 11/89*** | (2013.01) |

(52) U.S. Cl.
CPC ..... *A63H 5/04* (2013.01); *F41B 11/646* (2013.01); *F41B 11/89* (2013.01); *F41A 19/46* (2013.01)

(58) Field of Classification Search
CPC .... F41B 11/89; F41B 7/08; F41C 3/00; F41C 7/00; A63H 5/04; F41A 19/46
See application file for complete search history.

(56) References Cited

U.S. PATENT DOCUMENTS

| | | | | |
|---|---|---|---|---|
| 3,987,571 | A * | 10/1976 | Orozco | F41A 3/54 42/71.01 |
| 2010/0229843 | A1* | 9/2010 | Hu | F41B 11/62 124/80 |
| 2017/0089655 | A1* | 3/2017 | Geissele | F41A 19/46 |
| 2019/0093977 | A1* | 3/2019 | Kim | F41B 11/646 |
| 2020/0041221 | A1* | 2/2020 | Mesco | F41A 19/46 |

* cited by examiner

*Primary Examiner* — John E Simms, Jr.
(74) *Attorney, Agent, or Firm* — Leong C. Lei

(57) ABSTRACT

A single-shot/repeating switching device is provided for a toy gun that includes an outer casing, a bolt seat, a trigger link, and a trigger section. The single-shot/repeating switching device includes: an adjustment hole formed between the outer casing and the bolt seat, an adjustment seat having a toothed rail, a pinion rod rotatably arranged on the toothed rail, an operating portion arranged on the pinion rod and extended to outside of the adjustment hole, a coupling portion formed on the adjustment seat and opposite to the toothed rail, and a movable arrestor joined by a joining part to the coupling portion. A user may push, from the outside the operating portion to cause corresponding motions of the pinion rod and the toothed rail so as to drive the movable arrestor by means of the adjustment seat to selectively block a movement of the trigger link for efficient single-shot/repeating switchability.

7 Claims, 13 Drawing Sheets

SINGLE-SHOT/REPEATING SWITCHING DEVICE OF TOY GUN

TECHNICAL FIELD OF THE INVENTION

The present invention relates generally to an externally operated selective switch, and more particularly to a toy gun single-shot/repeating switching device that enables switching of a slide-less toy gun between a single-shot mode and a repeating mode.

DESCRIPTION OF THE PRIOR ART

Single-shot/repeating switchability is a common function for toy guns. A commonly known selective switch is arranged in combination with a safety catch to form a three-stage switch that is mounted on the gun body at a location above the trigger. Pulling the switch causes a linkage mechanism, which is often sophisticated, to drive a switching assembly arranged inside the slide in order to achieve the purpose of switching among single shot, repeating, and safety. Such a selective switch has various shortcomings. Firstly, the selective switch is entirely exposed on the outside and this destroy overall aesthetics. Secondly, for easiness of pulling or operating the selective switch, arrangement is often made in such a way as to be located on the side that faces an operator, and this, in combination with the design of being entirely exposed on the outside, makes it is very easy to be erroneously activated. Thirdly, the selective switch has a large area for being exposed to the outside and is easily damaged due to collision and impact. Fourthly, the selective switch and the switching assembly are arranged inside and outside the gun body separately, so that an additionally arranged linkage must be included and this greatly complicates the structure.

However, for a selective switch that is arranged to be completely concealed inside a toy gun, an operation of switching between single shot and repeating would need to first pull away the slide and aim the eyesight into the interior of the slide to search for the selective switch, and then use a finger nail to move the switch in a very limited space, and finally, close the slide. It is extremely disadvantageous for easiness of operation in switching between single shot and repeating. Particularly, during the course of switching, the eyesight has to be removed away from a desired target of shooting. This is an unfriendly arrangement and for utilization in survival games, this is even a more serious problem than erroneous activation.

SUMMARY OF THE INVENTION

Thus, the primary objective of the present invention is to provide a single-shot/repeating switching device of a toy gun that allows for operation of a selective switch from the outside to drive an internal mechanism through gears for switching between a single-shot mode and a repeating mode.

The primary objective of the present invention is to arranged a toothed rail and a pinion rod as an internal switch mechanism for single-shot/repeating switchability, so as to reduce overall structural complication and lower risk of damage.

Another objective of the present invention is to expose only a part of an operation portion of single-shot/repeating switchability outside an outer casing of a toy gun, in order to reduce the area of exposure for reducing erroneous activation risk while also ensuring easiness of operation.

To achieve the above objectives, the present invention provides a toy gun that comprises an outer casing, a bolt seat that is arranged, in a movable manner, to protrude from one side of the outer casing, a trigger link that is arranged on one side of the bolt seat, and a trigger section that is connected to the trigger link, and a single-shot/repeating switching device mainly comprises: an adjustment hole, an adjustment seat, a toothed rail, a pinion rod, an operating portion, a coupling portion, and a movable arrestor, wherein the adjustment hole is formed between the outer casing and the bolt seat; the adjustment seat is arranged in an interior of the bolt seat; the toothed rail is arranged on the adjustment seat; the pinion rod is rotatably arranged on the toothed rail in order to drive the adjustment seat to move by means of the toothed rail; the operating portion is arranged on one end of the pinion rod that is opposite to the toothed rail and is extended to outside of the adjustment hole for rotating the pinion rod; the coupling portion is formed on one side of the adjustment seat that is opposite to the toothed rail; and the movable arrestor is arranged on one side of the adjustment seat and is correspondingly joined by a joining part to the coupling portion.

A user, when operating the toy gun according to the present invention, only needs to move a finger toward a rear end of the bolt seat to push the operating portion that is exposed outside the adjustment hole leftwards/rightwards to conduct single-shot/repeating switching, and pushing the operating portion causes rotation of the pinion rod to drive, through engagement therewith, the toothed rail to move leftwards/rightwards so that the coupling portion pushes and moves the joining part of the movable arrestor to make the movable arrestor selectively blocking the trigger link. The movable arrestor, when abutting a sidewall of the bolt seat, is blocking the trigger link so as to set in the single-shot mode, and the movable arrestor, when separating from the sidewall of the bolt seat, allows the trigger link to pass so as to set in the repeating mode. As such, the slide-less toy gun demonstrates advantages in safely and efficiently switching between single-shot and repeating modes.

Based on the above-described technology, the shortcomings of the prior art toy gun that exposure of a switch of a single-shot/repeating switching arrangement to the outside results in poor aesthetics, easy erroneous activation, easy damage, structure sophistication, while complete concealment of a switch in an interior causes inconvenience of operation can be overcome and the above-discussed objective can be achieved.

DETAILED DESCRIPTION OF THE PREFERRED EMBODIMENT

Figure 1:
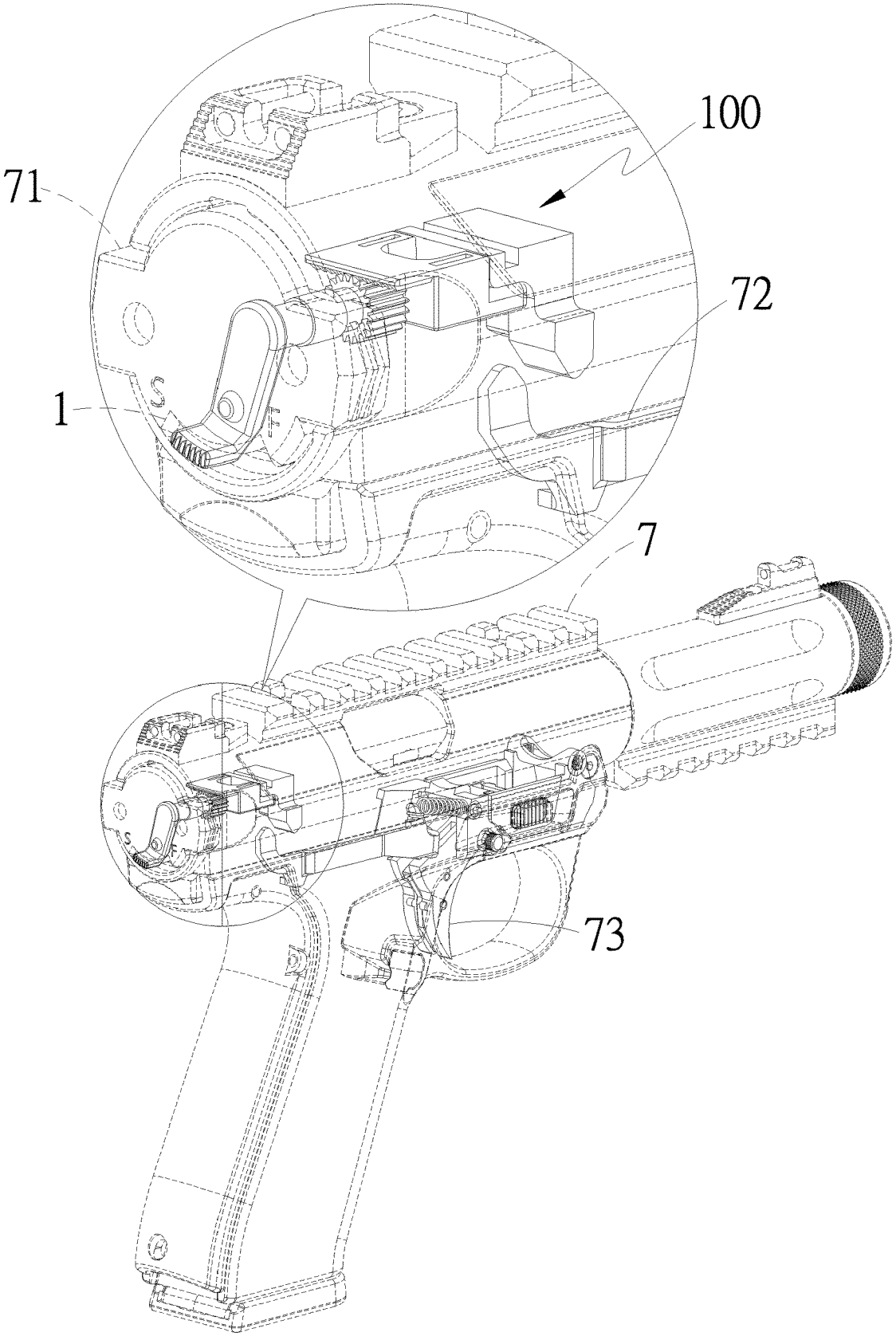
FIG. 1 is a perspective view, partly in a see-through form, showing a toy gun according to a preferred embodiment of the present invention.
Figure 2:
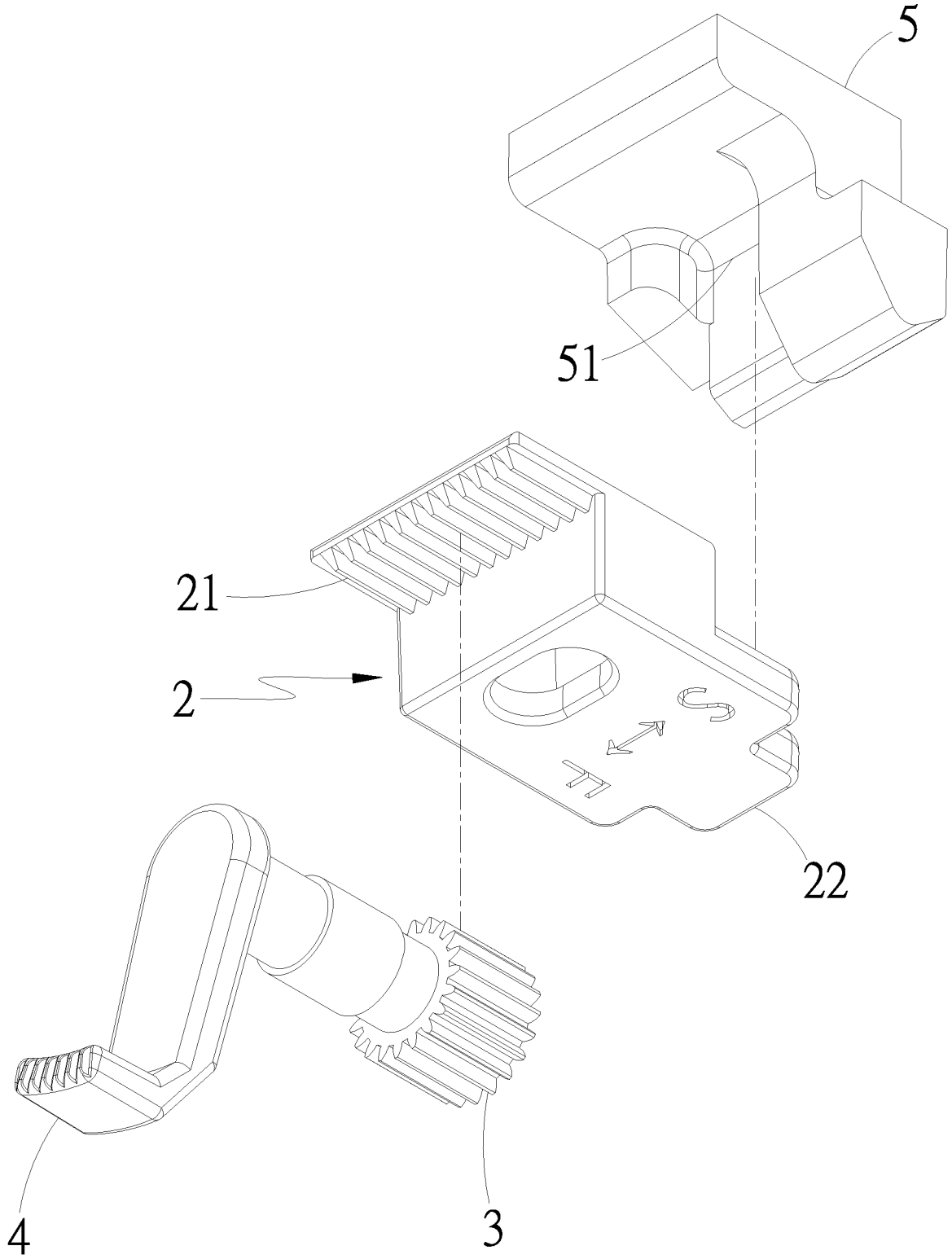
FIG. 2 is an exploded view showing a switching device according to the preferred embodiment of the present invention.
Figure 3:
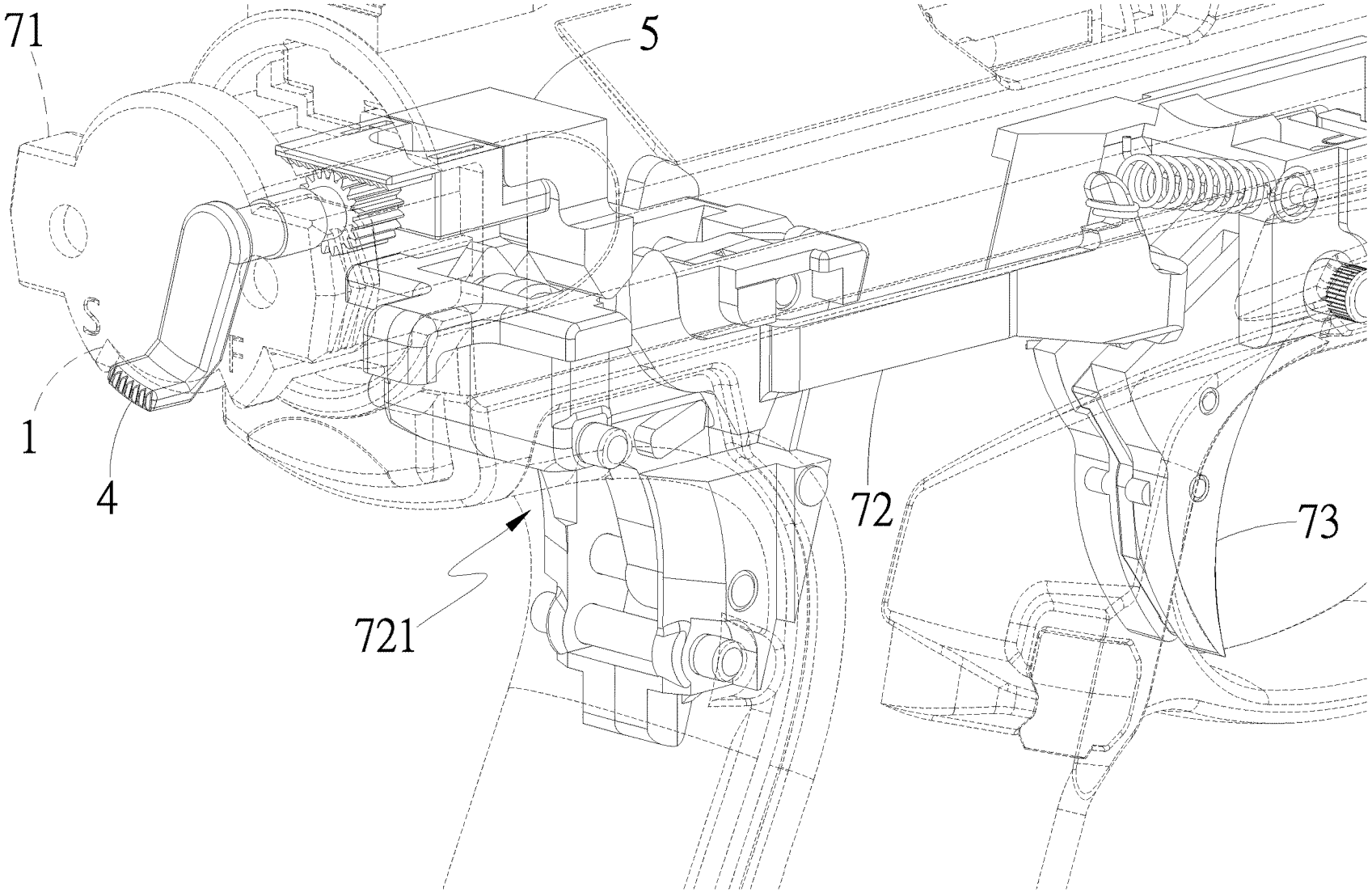
FIG. 3 is a schematic view showing a single-shot firing state of the preferred embodiment of the present invention.
Figure 4:
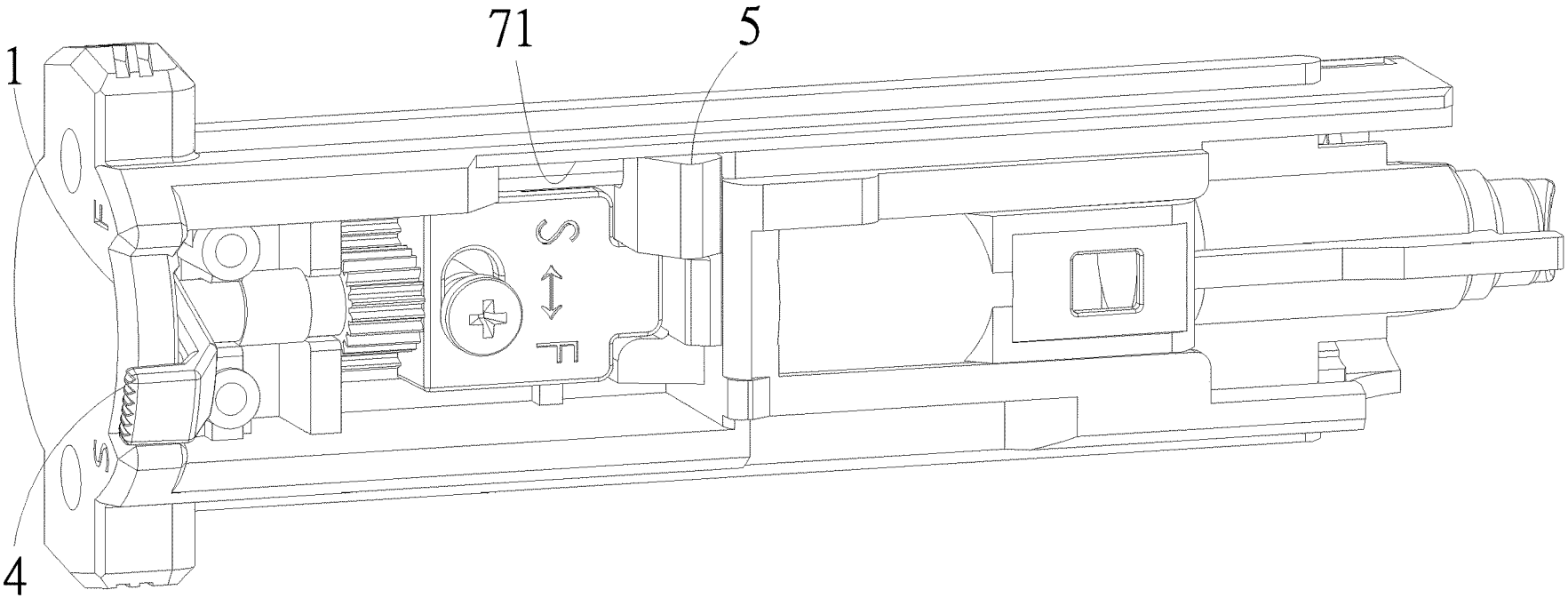
FIG. 4 is another schematic view showing the single-shot firing state of the preferred embodiment of the present invention.
Figure 5:
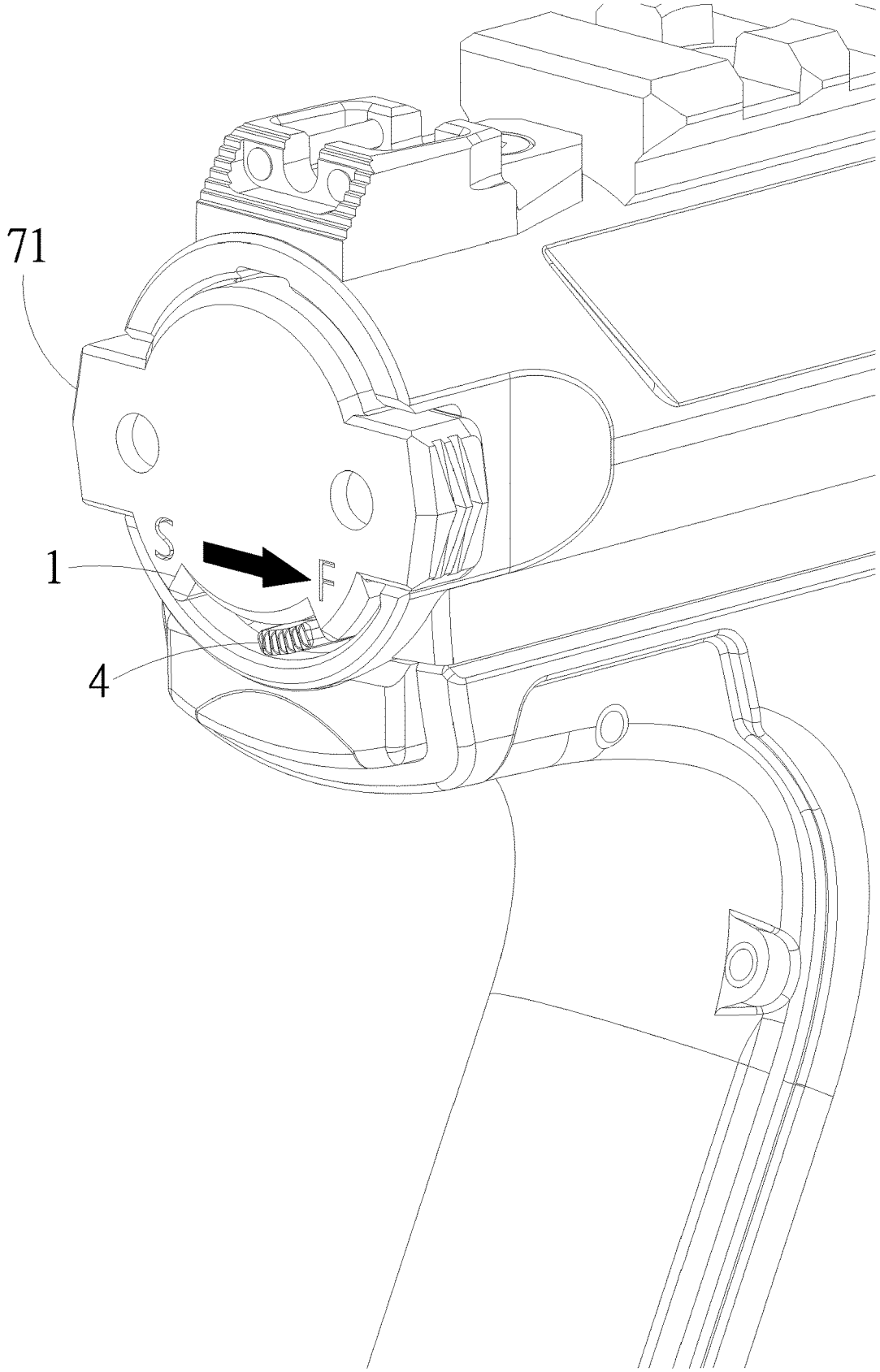
FIG. 5 is a schematic view demonstrating operation of the preferred embodiment of the present invention.
Figure 6:
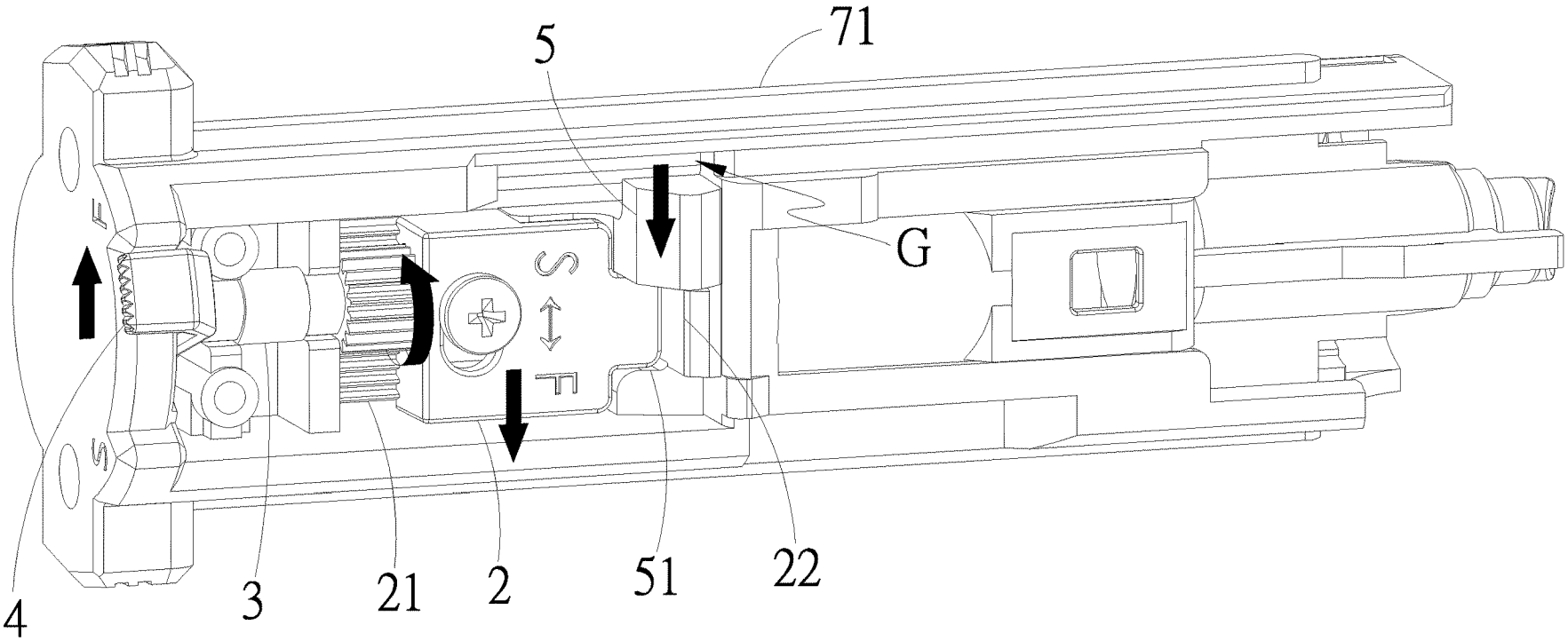
FIG. 6 is a schematic view demonstrating action of the preferred embodiment of the present invention.

Referring to FIGS. 1 and 2, which are respectively a perspective view, in a see-through form, showing a toy gun according to a preferred embodiment of the present invention and an exploded view showing a switching device according to the preferred embodiment of the present invention, it is clearly seen from the drawings that the toy gun according to the present invention comprises an outer casing 7, a bolt seat 71 arranged, in a movable manner, to protrude from one side of the outer casing 7, a trigger link 72 arranged on one side of the bolt seat 71, and a trigger section 73 connected to the trigger link 72. A single-shot/repeating switching device 100 mainly comprises:

- an adjustment hole 1, which is formed between the outer casing 7 and the bolt seat 71, an arc opening being taken as an example in the instant embodiment;
- an adjustment seat 2, which is arranged in an interior of the bolt seat 71;
- a toothed rail 21, which is arranged on the adjustment seat 2;
- a pinion rod 3, which is rotatably arranged on the toothed rail 21 in order to drive the adjustment seat 2 to move by means of the toothed rail 21;
- an operating portion 4, which is arranged on one end of the pinion rod 3 that is opposite to the toothed rail 21 and is extended to outside of the adjustment hole 1 for rotating the pinion rod 3;
- a coupling portion 22, which is formed on one side of the adjustment seat 2 that is opposite to the toothed rail 21; and
- a movable arrestor 5, which is arranged on one side of the adjustment seat 2 and is correspondingly joined by a joining part 51 to the coupling portion 22, wherein the movable arrestor 5, when abutting a sidewall of the bolt seat 71, blocks the trigger link 72, so as to switch to a single-shot mode, and the movable arrestor 5, when separating from the sidewall of the bolt seat 71, allows the trigger link 72 to pass to switch to a repeating mode, and in the instant embodiment, the coupling portion 22 being made in the form of a projection and the joining part 51 being made in the form of a recess is taken as an example for illustration.

Based on the description provided above, the structure of the present invention can be understood, and based on corresponding and collaboration of such a structure, an external operation for the selective switch is available for operating gears to drive the internal mechanism in order to perform single-shot/repeating switching for the slide-less toy gun. Further details are provided below.

Figure 7:
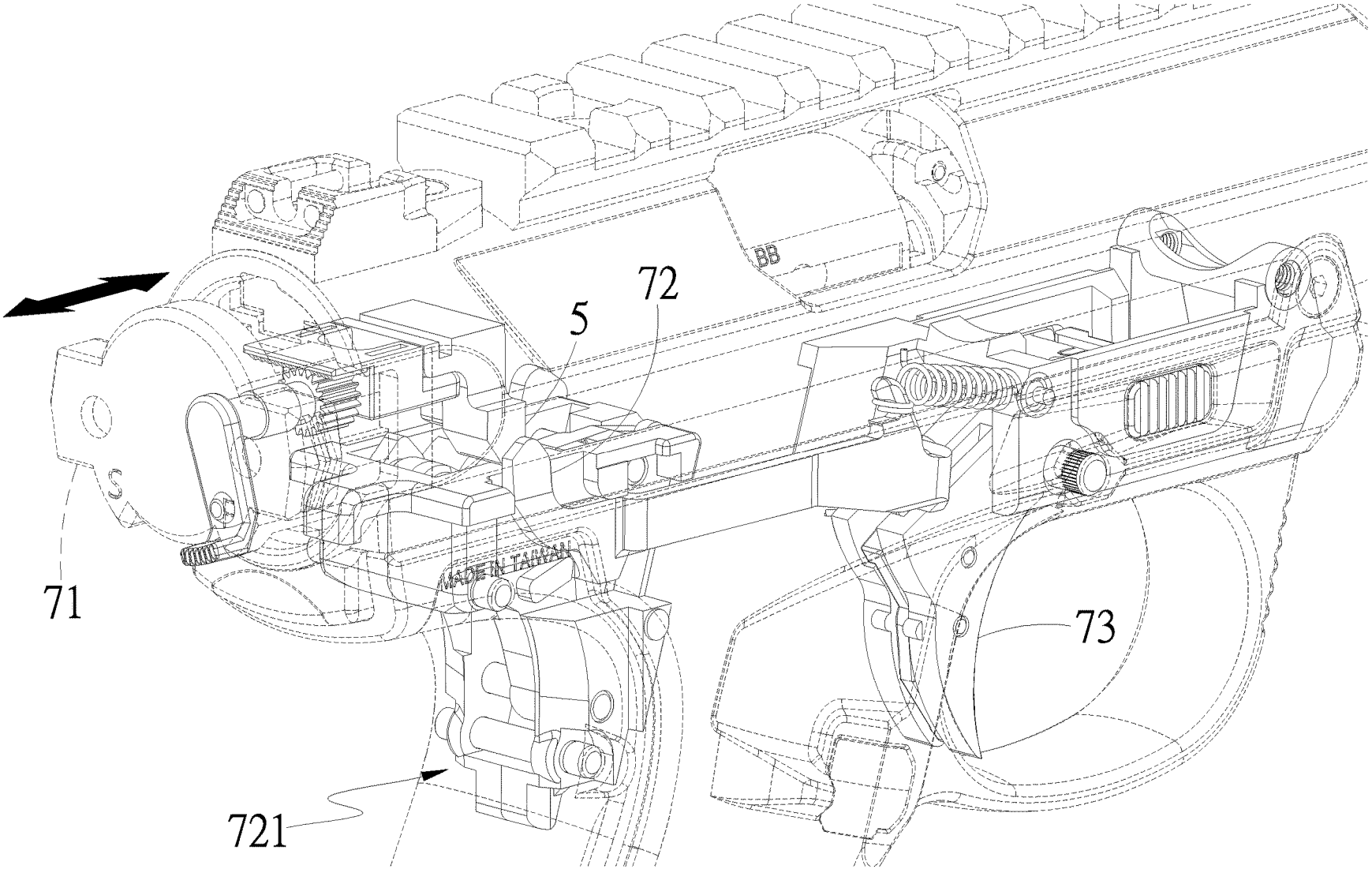
FIG. 7 is a schematic view showing a repeating firing state of the preferred embodiment of the present invention.
Figure 7A:
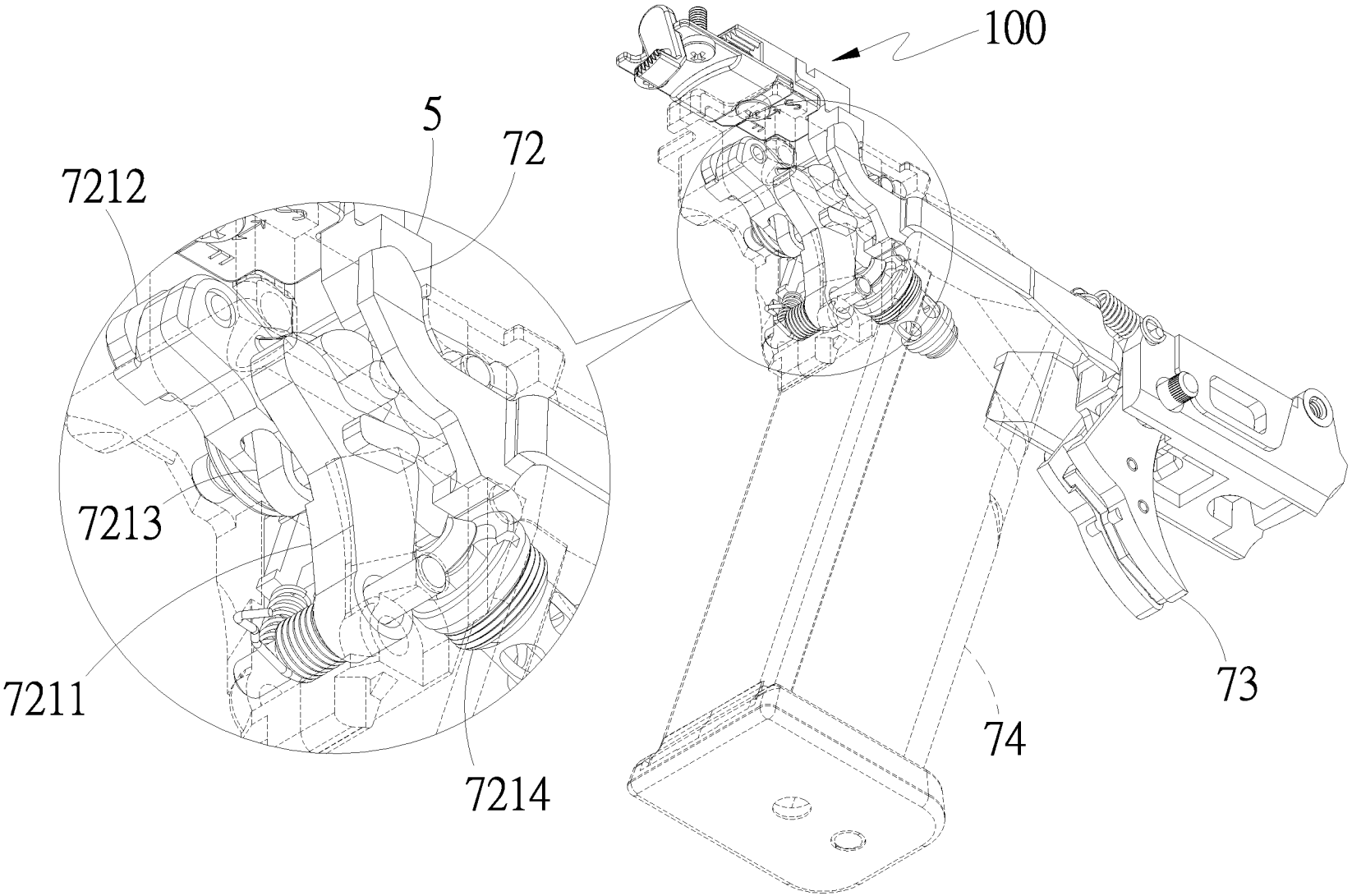
FIG. 7A is a perspective view, taken from a different angle, showing the preferred embodiment of the present invention shown in FIG. 7.
Figure 7B:
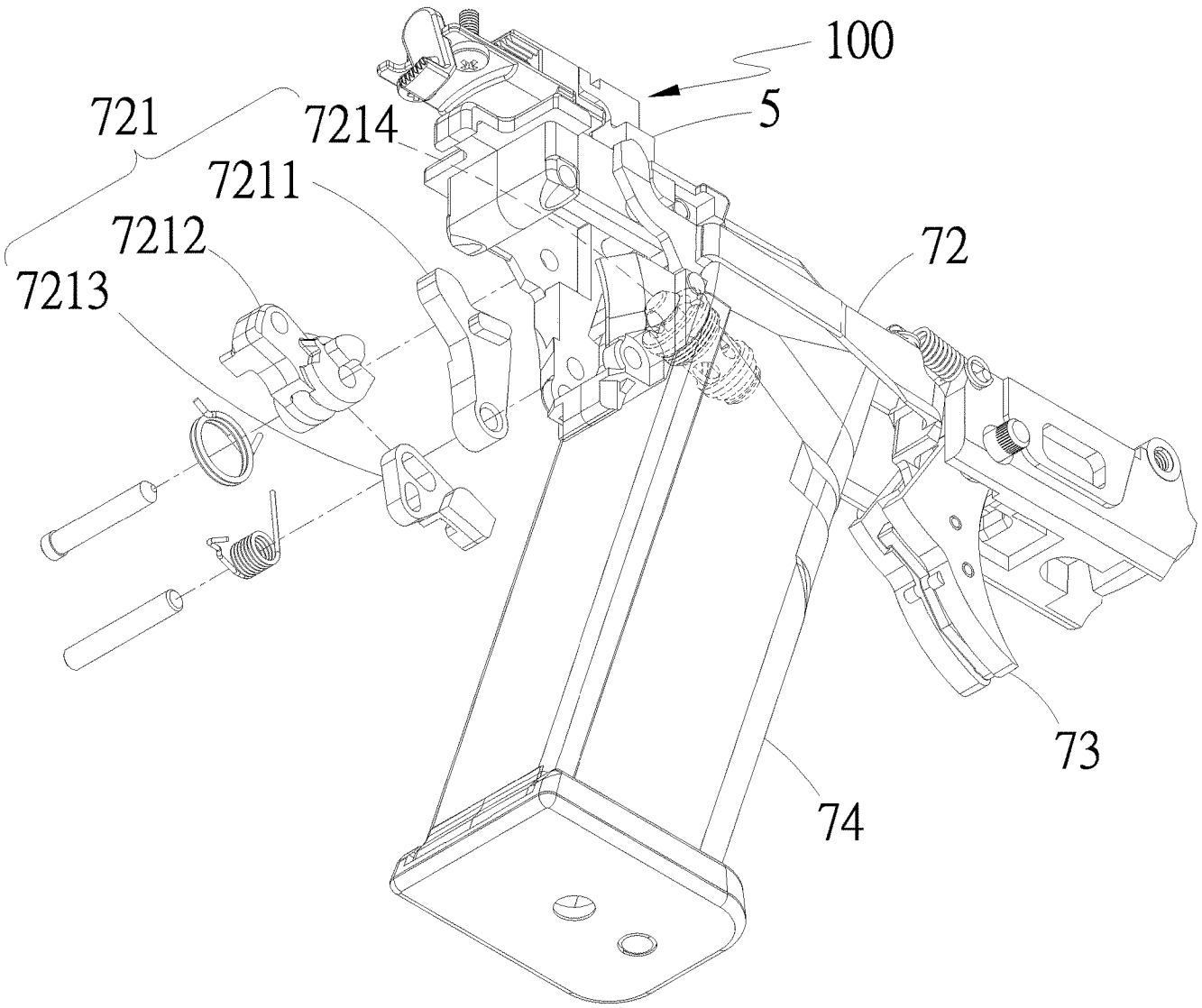
FIG. 7B is an exploded view showing a transmission assembly of the preferred embodiment of the present invention.
Figure 7C:
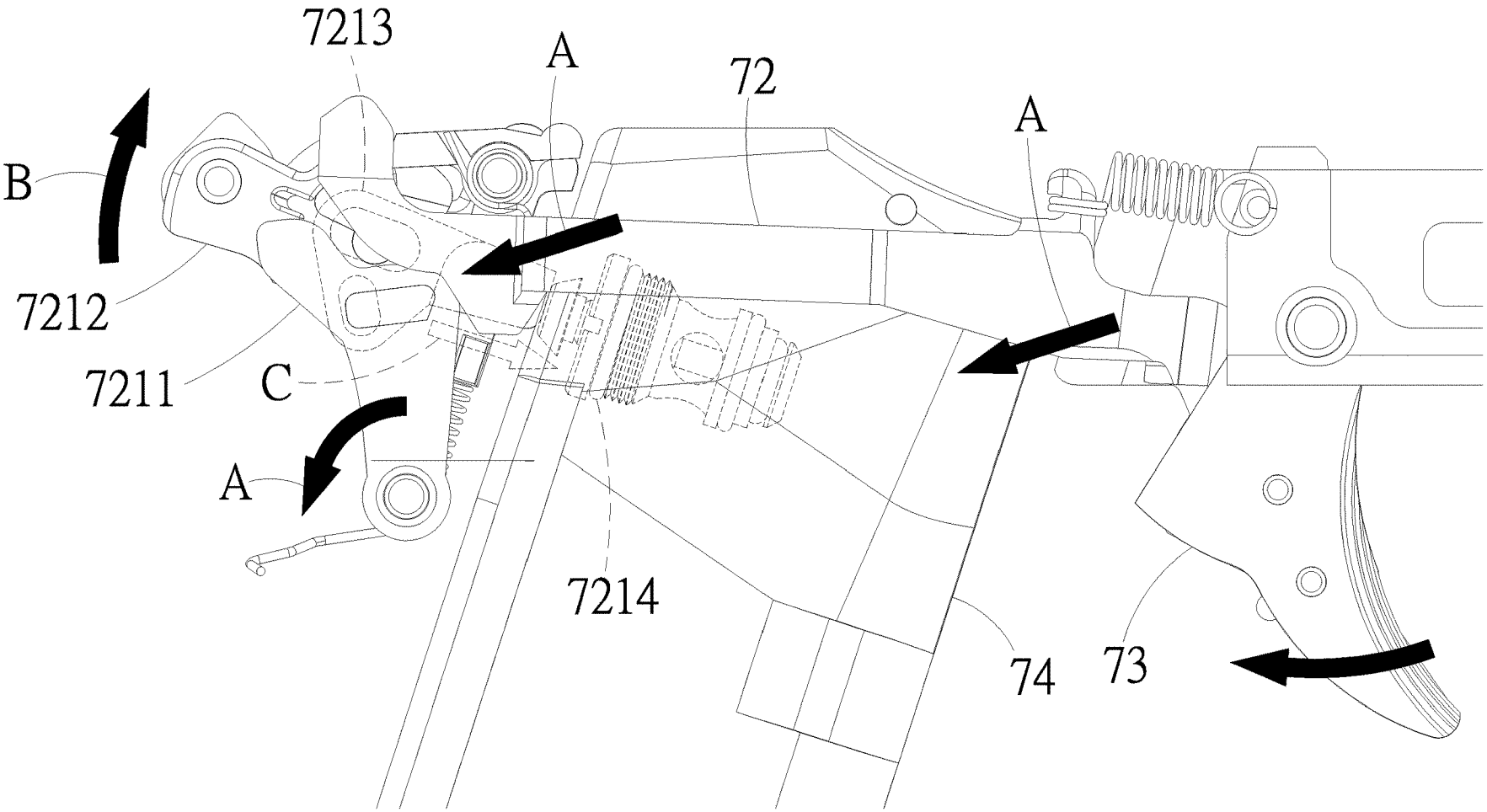
FIG. 7C is another schematic view showing the repeating firing state of the preferred embodiment of the present invention.

Referring simultaneously to FIGS. 1-7C, which are respectively a perspective view, in a see-through form, showing a toy gun according to a preferred embodiment of the present invention, an exploded view showing a switching device according to the preferred embodiment of the present invention, a schematic view showing a single-shot firing state of the preferred embodiment of the present invention, another schematic view showing the single-shot firing state of the preferred embodiment of the present invention, a schematic view demonstrating operation of the preferred embodiment of the present invention, a schematic view demonstrating action of the preferred embodiment of the present invention, a schematic view showing a repeating firing state of the preferred embodiment of the present invention, a perspective view, taken from a different angle, showing the preferred embodiment of the present invention shown in FIG. 7, an exploded view showing a transmission assembly of the preferred embodiment of the present invention, and another schematic view showing the repeating firing state of the preferred embodiment of the present invention, with the above-described components being assembled as noted above, it is clearly seen from the drawings that the toy gun according to the present invention is a pneumatic hand gun that does not includes a slide on a surface thereof and that only makes the bolt seat 71 in the interior of the outer casing 7 projecting outward when loaded or firing. Further the toy gun according to the present invention is such that the operating portion 4 of the single-shot/repeating switching device 100 is partly exposed outside the bolt seat 71, rather than being at one side of the trigger section 73.

When the toy gun is in the single-shot state, the operating portion 4 is set at a predetermined location, which is marked "S", on the adjustment hole 1. In this state, the movable arrestor 5 abuts the sidewall of the bolt seat 71, so that in a course of forward-backward movement, the bolt seat 71 is prevented from continuing moving due to the trigger link 72 being arrested by the movable arrestor 5, and consequently, when the user presses down the trigger section 73 once, the transmission assembly 721 drives the bolt to move reciprocally one round to achieve one firing, and further, the transmission assembly 721 comprises a sear 7211 that is arranged at one side of the trigger link 72, a striker 7212 that is arranged at one side of the sear 7211, a firing pin 7213 that is arranged at one side of the striker 7212, and a magazine air valve 7214 that is arranged at one side of the firing pin 7213, so that when the trigger section 73 is released, the bolt seat 71 pushes away the trigger link 72 to return to an original position to get ready for the next firing operation; however, if the user holds down the trigger section 73, although the transmission assembly 721 may drive the bolt seat 71 to move backward to achieve one firing, yet the trigger link 72 is prevented from dropping down due to the trigger section 73 being held, so that the trigger link 72 cannot push the sear 7211, thereby keeping the sear 7211 in a held state and no firing is possible, and at this moment, the striker 7212 stops the movable arrestor 5 due to the bolt seat 71 moving backward, preventing the bolt seat 71 from returning back to the original position, and thus, the user, even still holding down the trigger section 73, is not allowed to do repeating firing.

When the user attempts to switch to the repeating mode, there is no need to pull open the bolt seat 71, and it only needs to operate the operating portion 4 that is exposed outside the bolt seat 71 to move rightward to the location that is marked "F" above the adjustment hole 1 to complete the operation of switching to the repeating mode, the operation being easy and efficient, and due to only a limited portion of the operating portion 4 being exposed, the risk of erroneous activation is greatly reduced, and the outside appearance aesthetics is not affected. After switching to the repeating mode, concerning the operation of the transmission assembly 721, since the movable arrestor 5 is not blocked by the trigger link 72, when the trigger section 73 is being continuously pressed down, the trigger link 72 is pushed down by the sear 7211 (as indicated by arrow "A"), making the striker 7212 not held by the sear 7211 and instead pushed down by the bolt seat 71 (as indicated by arrow "B"), so that the striker 7212, after being released, drives the firing pin 7213, making the firing pin 7213 pressing down the magazine air valve 7214 (as indicated by arrow "C"), thereby making pressurized gas continuously released from the magazine 74 to complete repeating firing. However, the specifics of the operation of the transmission assembly 721 described above are not features of this invention, so that no further details are provided herein.

When the operating portion 4 is pushed rightwards, the pinion rod 3 is rotated counterclockwise, and a pinon on the pinion rod 3 is in mating engagement with the toothed rail 21 of the adjustment seat 2, this increasing the combination strength and preventing undesired loosening, so that the adjustment seat 2 is driven to move leftwards, and the coupling portion 22 of the adjustment seat 2 is correspondingly joined to the joining part 51 of the movable arrestor 5, making the adjustment seat 2, in the leftward movement thereof, drives the movable arrestor 5 to move leftwards, and at this moment, the movable arrestor 5 is separated from the sidewall of the bolt seat 71 and a gap "G" is formed to allow the trigger link 72 to pass. Thus, if the user is holding down the trigger section 73, although the trigger link 72 is not allowed to drop down due to the trigger section 73 being held, yet due to the existence of the gap "G", the movable arrestor 5 is not blocked by the trigger link 72 and the transmission assembly 721 continuously makes the bolt seat 71 proceed with successive reciprocal movement, and thus, in the repeating mode, the transmission assembly 721 is not just capable of driving the bolt seat 71 to do reciprocal motion one time and, in case that the user keeps on holding down the trigger section 73, the transmission assembly 721 may perform an operation of repeating firing.

Figure 8:
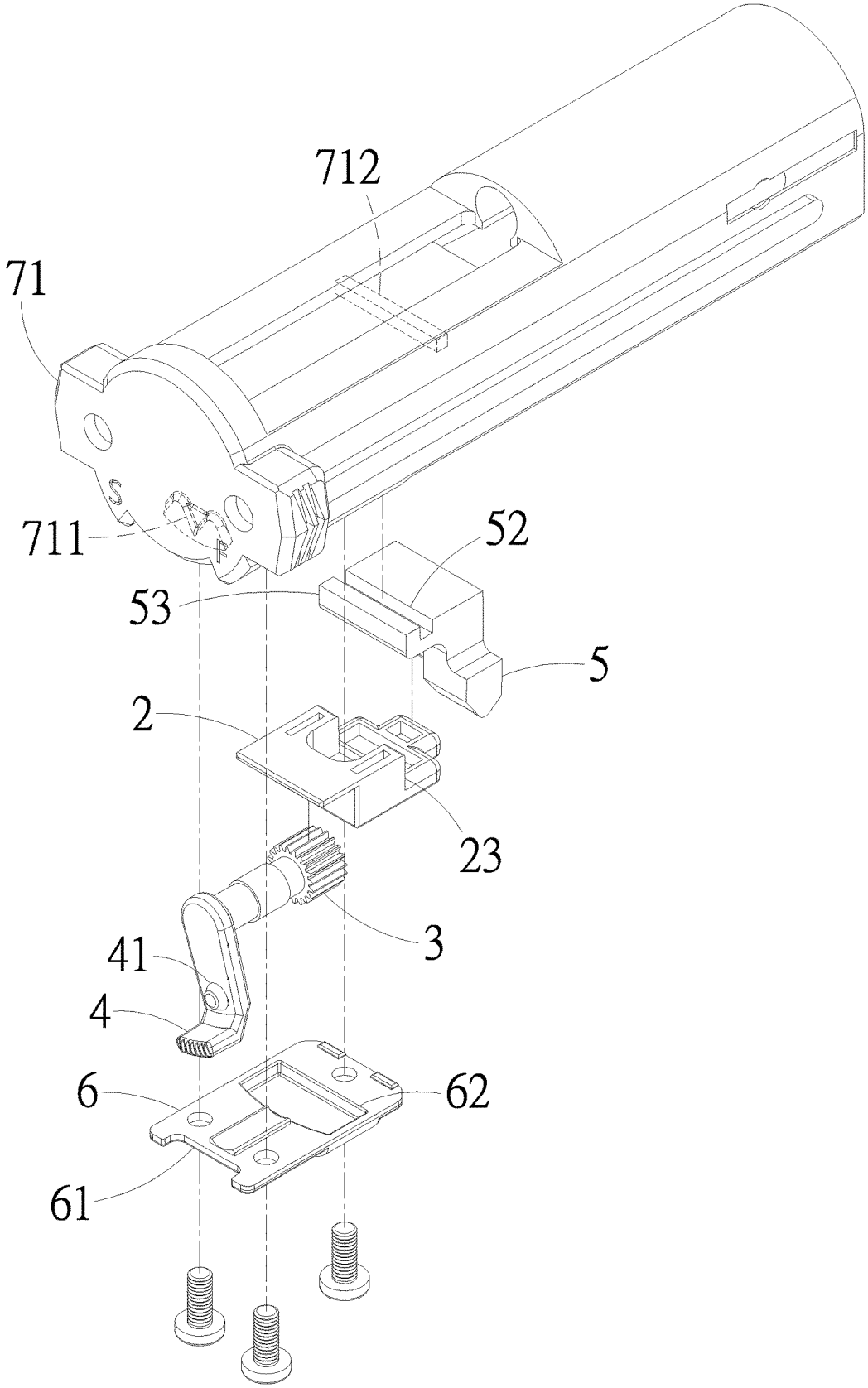
FIG. 8 is an exploded view showing another preferred embodiment according to the present invention.
Figure 9:
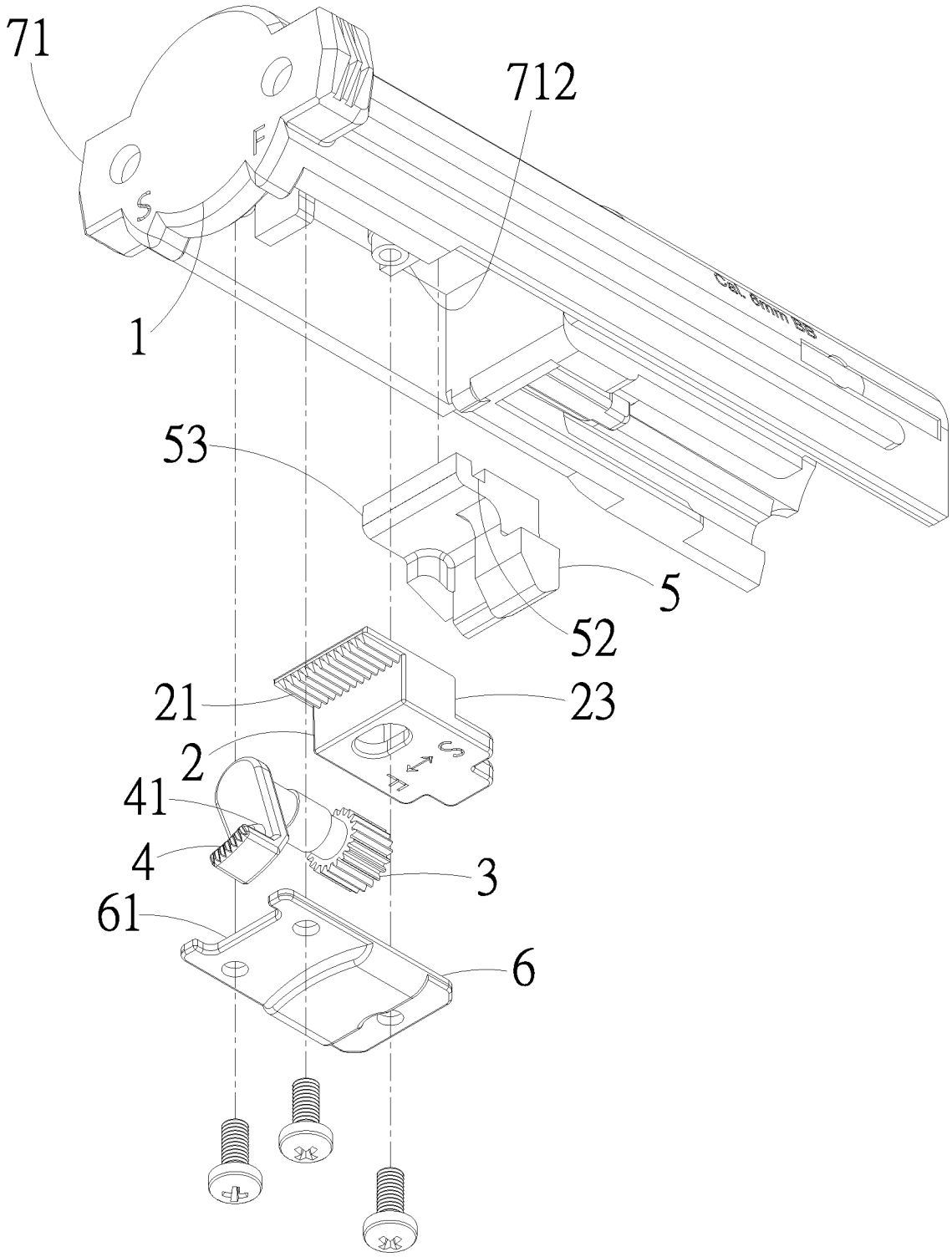
FIG. 9 is another exploded view, taken from another angle, showing said another preferred embodiment of the present invention.
Figure 10:
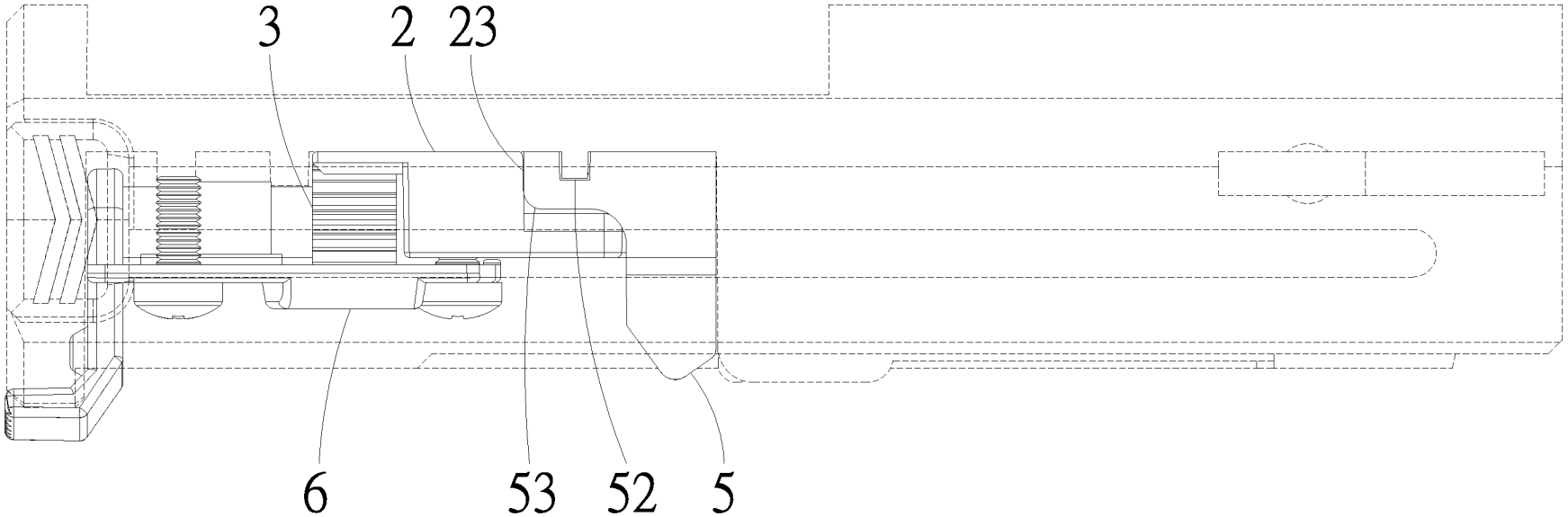
FIG. 10 is a side elevational view showing said another preferred embodiment of the present invention.

Referring to FIGS. 8-10, which are respectively an exploded view showing another preferred embodiment according to the present invention, another exploded view, taken from another angle, showing said another preferred embodiment of the present invention, and a side elevational view showing said another preferred embodiment of the present invention, it is clearly seen from the drawings that the instant embodiment is similar to the previous embodiment and is different in that a carrying member 6 is arranged in the interior of the bolt seat 71 for supporting and carrying the adjustment seat 2 and the pinion rod 3. The bolt seat 71 is provided, at one side thereof adjacent to the operating portion 4, with two limiting grooves 711, and the bolt seat 71 is provided with a limiting rib 712, and the operating portion 4 is provided, at one side thereof adjacent to the bolt seat 71, with a limiting protrusion 41. The limiting protrusion 41 is correspondingly engageable with either one of the limiting grooves 711. The carrying member 6 is provided, at one side thereof adjacent to the operating portion 4, with a first avoidance portion 61, and the carrying member 6 is provided, at one side thereof adjacent to the pinion rod 3, with at least one second avoidance portion 62. The movable arrestor 5 is formed with a retention groove portion 52 correspondingly engageable with the limiting rib 712, and the movable arrestor 5 is provided, at one side thereof, with an abutting block 53, and the adjustment seat 2 is provided, at one side thereof, with an abutting portion 23, which is in abutting engagement with the abutting block 53, so as to have the pinion rod 3 coupled to the toothed rail 21.

In this embodiment, the two limiting grooves 711 of the bolt seat 71 jointly form a limiting space in the form of a W-shaped configuration, so that the cylinder-like limiting protrusion 41 of the operating portion 4 is fixable or retainable in one of the limiting grooves 711 to ensure that the operating portion 4 can be correctly positioned at one of the ends of the adjustment hole 1, preventing the user from misjudging the current firing (single-shot or repeating) mode of the toy gun.

In this embodiment, the abutting block 53 is arranged as a structure of the movable arrestor 5 that projects in a direction toward the adjustment seat 2 and is set in abutting engagement with the abutting portion 23 of the adjustment seat 2, so as to make the toothed rail 21 of the adjustment seat 2 in close engagement with the pinion of the pinion rod 3, preventing difference between the two in respect of frontward-backward positions thereof thereby ensuring an effect of driving by means of tooth engagement. Further, the abutting block 53 is provided with the retention groove portion 52 that is made in the form of a horizontal groove for corresponding engagement with the limiting rib 712 of the bolt seat 71, and consequently, making the movable arrestor 5 and the bolt seat 71 not displacing frontwards/backwards, this in combination with the above-discussed abutting block 53 and abutting portion 23 also fixing and retaining the adjustment seat 2 in position, thereby preventing difference between the toothed rail 21 and the pinion rod 3 in respect of frontward-backward positions thereof.

Further, the carrying member 6 provides an arrangement for holding the bolt seat 71 so that the carrying member 6 supports, from the lower side, the pinion rod 3 and the adjustment seat 2 to prevent an inclining angle formed between the pinion of the pinion rod 3 and the toothed rail 21, and as such, the effect of driving through tooth engagement can be assured and a movement gap can be provided between the operating portion 4 and a wall of the adjustment hole 1 to prevent the operating portion 4 from easy damage due to being hard to smoothly move. Further, the carrying member 6 is provided with the first avoidance portion 61 and the second avoidance portion 62 that are in the form of two troughs. The first avoidance portion 61 is a U-shaped trough in one end of the carrying member 6 for enabling normal oscillation of the operating portion 4, and the second avoidance portion 62 is an inwardly recessed structure formed in a surface of the carrying member 6 for enabling normal rotation of the pinion rod 3. The arrangement of the first avoidance portion 61 and the second avoidance portion 62, in addition to having the adjustment seat 2 supported in an upward direction by the carrying member 6, prevents undesired interference with operations of the operating portion 4 and the pinion rod 3.

I claim:

1. A single-shot/repeating switching device of a toy gun, the toy gun comprising an outer casing, a bolt seat that is arranged, in a movable manner, to protrude from one side of the outer casing, a trigger link that is arranged on one side of the bolt seat, and a trigger section that is connected to the trigger link, the single-shot/repeating switching device mainly comprising:

an adjustment hole, which is formed between the outer casing and the bolt seat;

an adjustment seat, which is arranged in an interior of the bolt seat;

a toothed rail, which is arranged on the adjustment seat;

a pinion rod, which is rotatably arranged on the toothed rail in order to drive the adjustment seat to move by means of the toothed rail;

an operating portion, which is arranged on one end of the pinion rod that is opposite to the toothed rail and is extended to outside of the adjustment hole for rotating the pinion rod;

a coupling portion, which is formed on one side of the adjustment seat that is opposite to the toothed rail; and a movable arrestor, which is arranged on one side of the adjustment seat and is correspondingly joined by a joining part to the coupling portion, wherein the movable arrestor, when abutting a sidewall of the bolt seat, blocks the trigger link so as to set in a single-shot mode, and the movable arrestor, when separating from the bolt seat, allows the trigger link to pass, so as to set to a repeating mode.

2. The single-shot/repeating switching device of the toy gun according to claim 1, wherein the bolt seat is provided, at one side thereof adjacent to the operating portion, with two limiting grooves, and the operating portion is provided, at one side thereof adjacent to the bolt seat, with a limiting protrusion, the limiting protrusion being correspondingly engageable with one of the limiting grooves.

3. The single-shot/repeating switching device of the toy gun according to claim 1, wherein the bolt seat is provided, in the interior thereof, with a carrying member, which supports the adjustment seat the pinion rod.

4. The single-shot/repeating switching device of the toy gun according to claim 3, wherein the carrying member is provided, at one side thereof adjacent to the operating portion, with a first avoidance portion.

5. The single-shot/repeating switching device of the toy gun according to claim 3, wherein the carrying member is provided, at one side thereof adjacent to the pinion rod, with at least one second avoidance portion.

6. The single-shot/repeating switching device of the toy gun according to claim 1, wherein the movable arrestor is provided, at one side thereof, with an abutting block, and the adjustment seat is provided, at one side thereof, with an abutting portion, which is in abutting engagement with the abutting block, so as to have the pinion rod coupled to the toothed rail.

7. The single-shot/repeating switching device of the toy gun according to claim 1, wherein the movable arrestor is formed with a retention groove portion, with which a limiting rib provided on the bolt seat is engageable.

* * * * *